US005287913A

United States Patent [19]

Dunning et al.

[11] Patent Number: 5,287,913

[45] Date of Patent: Feb. 22, 1994

[54] HOSE ASSEMBLY AND TEMPERATURE CONTROL SYSTEM UTILIZING THE HOSE ASSEMBLY

[76] Inventors: Dave Dunning, 37894 Lakeville Dr., Mt. Clemens, Mich. 48045; William Cline, 6417 Basswood, Troy, Mich. 48098

[21] Appl. No.: 890,178

[22] Filed: May 29, 1992

[51] Int. Cl.[5] ..... F25B 29/00; F28F 27/00; F28F 27/02

[52] U.S. Cl. ..... 165/26; 165/34; 165/48.1; 165/61; 165/154; 137/340; 222/146.1; 222/146.5; 222/146.6; 239/133; 239/134; 392/468; 392/472; 392/480

[58] Field of Search ..... 165/184, 61, 26, 34, 165/48.1; 137/340, 13; 392/468, 472, 476, 477, 480; 126/343.5 R; 222/146.1, 146.5, 146.6; 239/133, 134

[56] References Cited

U.S. PATENT DOCUMENTS

| | | | |
|---|---|---|---|
| 752,768 | 2/1904 | Goodwin . | |
| 946,041 | 1/1910 | Heer . | |
| 1,025,758 | 5/1912 | Martini . | |
| 1,247,937 | 11/1917 | Cumfer | 137/340 |
| 2,316,376 | 4/1943 | Weiss | 165/154 |
| 2,410,912 | 11/1946 | Wenk | 165/154 |
| 2,658,527 | 11/1953 | Kaiser | 137/340 |
| 2,707,313 | 5/1955 | McShurley et al. | 137/340 |
| 2,762,901 | 9/1956 | Liedberg | 137/340 |
| 3,105,708 | 10/1963 | Esty | 165/154 |
| 3,146,950 | 9/1964 | Lancaster | 165/64 |
| 3,590,855 | 7/1971 | Woolen | 137/375 |
| 3,690,292 | 9/1972 | Pasley | 118/59 |
| 3,934,618 | 1/1976 | Henderson | 165/154 |
| 4,140,150 | 2/1979 | Rundell | 137/340 |
| 4,600,124 | 7/1986 | Price | 392/472 |
| 4,667,852 | 5/1987 | Siemann | 222/54 |
| 4,890,573 | 1/1990 | Zaber | 118/667 |
| 4,898,527 | 2/1990 | Claassen | 425/143 |
| 4,998,502 | 3/1991 | Schucker | 118/667 |
| 5,029,731 | 7/1991 | Klatt | 222/54 |
| 5,146,946 | 9/1992 | Maugans | 137/340 |

*Primary Examiner*—John K. Ford
*Attorney, Agent, or Firm*—Krass & Young

[57] ABSTRACT

A temperature control system for an adhesive application system in which adhesive is delivered from a pump to a nozzle for application in bead form to a part. The control system includes a hose assembly extending from the pump to the nozzle and including an inner hose for carrying the adhesive and an outer hose defining an annular space between the outer hose and the inner hose for passage of water in a direction opposite to the direction of flow of the adhesive; a water conditioner selectively heating and cooling the water; and a controller receiving a reference signal representing a desired temperature of the adhesive at the nozzle and an actual adhesive temperature signal provided by a temperature sensor sensing the temperature of the adhesive being delivered to the nozzle and operative to compare the signals and generate appropriate signals for control of the water conditioner in a sense to maintain the desired water temperature and thereby the desired adhesive temperature. The hose assembly includes rigid end blocks with the outer hose extending between the end blocks and the inner hose communicating at its opposite ends with central passages in the respective end blocks to allow the delivery of adhesive through one end block, through the inner hose, and through the other end block to the nozzle. The end blocks also include passages communicating with the space between the hoses to allow the delivery of water to the space and the discharge of water from the space.

4 Claims, 3 Drawing Sheets 10
12
14
16
18
20
22
24
26
28
30
32
38
50
70
72
74
78
80
86
92
94
30l
30d
30m
38a
38b

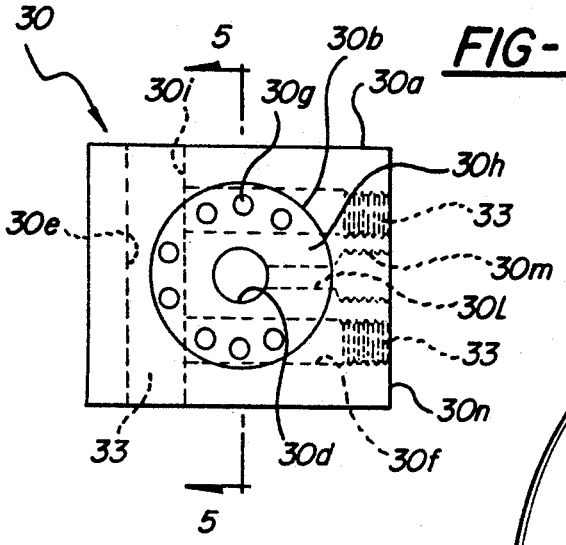
FIG-4
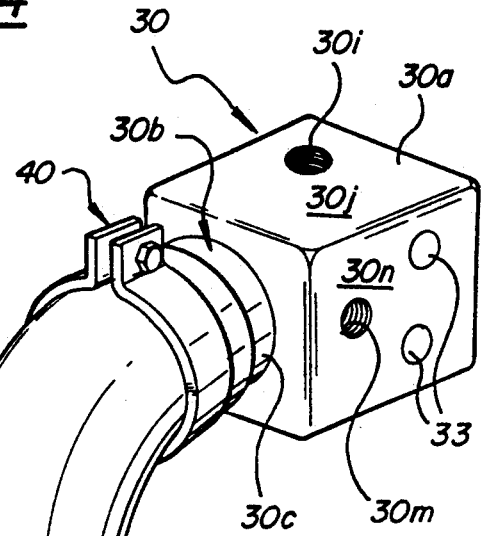
FIG-3
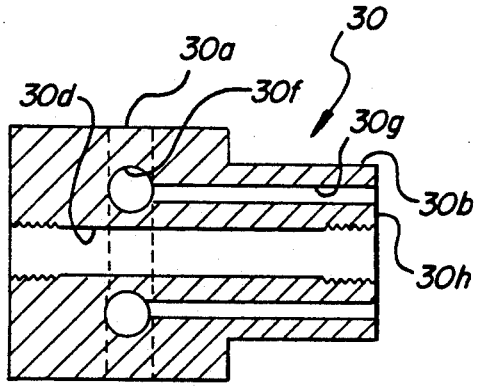
FIG-5
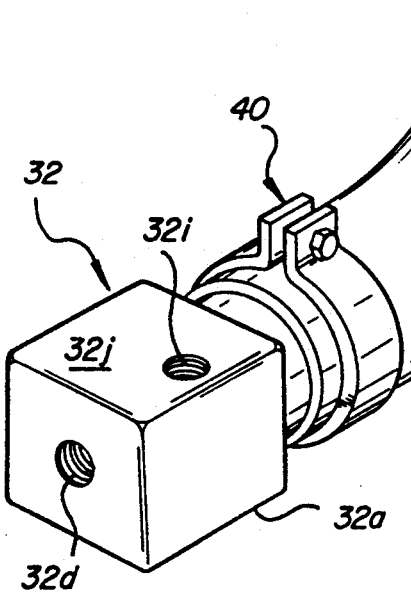
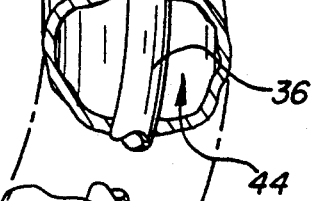
FIG-6
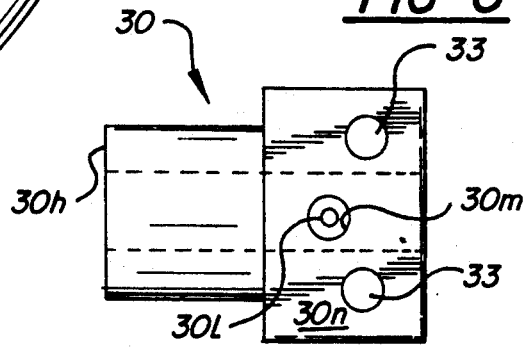

HOSE ASSEMBLY AND TEMPERATURE CONTROL SYSTEM UTILIZING THE HOSE ASSEMBLY

BACKGROUND OF THE INVENTION

This invention relates to hose a assembly and to a temperature control system utilizing the invention hose assembly.

There are many industrial applications (for example the manufacture of motor vehicles) where it is necessary to provide a bead of viscous adhesive material for application to a surface of a part to facilitate the attachment of the part to other parts. The adhesive bead is typically provided by a system including an adhesive pump supplying adhesive material to a nozzle which may, for example, be mounted on a robot so as to allow the nozzle to be movable by the robot in any desired motion program so as to apply a predetermined pattern of adhesive beading to the part. In order for such systems to operate successfully, it is important that the viscosity of the adhesive bead be carefully controlled at all times so as to provide a desired and preprogrammed flow of the adhesive bead onto the surface of the part. Control of the rate of flow of the adhesive material involves, among other parameters, control of the temperature of the adhesive. Whereas various temperature control systems have been proposed to control the temperature of the adhesive flowing between the adhesive pump and the nozzle, the prior art temperature control systems are either ineffective to precisely control the temperature and thereby the viscosity of the adhesive and/or are unduly complicated and unduly expensive.

SUMMARY OF THE INVENTION

This invention is directed to the provision of an improved temperature control system for an adhesive applicator system.

More particularly, this invention is directed to the provision of an improved hose assembly for use in a temperature control system for an adhesive applicator system.

The hose assembly according to the invention comprises a pair of rigid end blocks, each having an inboard end and an outboard end, each including a central through axial passage extending from the inboard end to the outboard end of the block, and each defining an annular hose mounting surface proximate the inboard end of the block in surrounding relation to the inboard end of the central passage; an outer flexible hose fitted at its respective opposite ends on the annular hose mounting surfaces of the end blocks; an inner flexible hose positioned within the outer flexible hose with an annular space therebetween and including opposite ends respectively communicating with the inboard ends of the central passages in the end blocks; and means defining a further, heat transfer passage in each end block communicating at one end thereof with the exterior of the block and communicating at the other end thereof with the annular passage between the inner and outer hoses. This specific hose assembly construction facilitates the passage of a working fluid material through the central through bores of the end blocks and through the inner hose and the passage of a heat transfer fluid material through the heat transfer passages in the end blocks and through the annular space defined between the inner and outer hoses.

According to a further feature of the invention hose assembly, the hose assembly further includes a temperature sensor mounted in one of the end blocks and including a probe extending into the central passage of the one block. This arrangement provides a convenient means of sensing the temperature of the working fluid material moving through the inner hose so as to facilitate the control of the temperature of the heat transfer fluid in the annular space and thereby of the working fluid moving through the inner hose.

According to a further feature of the invention hose assembly, each block has a polygonal cross-sectional configuration proximate its outboard end and a circular cross-sectional configuration proximate its inboard end; the outer hose has a circular configuration and is fitted at its opposite ends over the circular inboard ends of the respective end blocks; and the outer or exterior end of each heat transfer passage means in each block opens in a polygonal side face of the block. This specific end block construction allows the convenient mounting of the inner and outer hoses to the end blocks and the convenient delivery of fluid through the end blocks to the annular space between the hoses.

The invention temperature control system is operative to deliver a viscous material from a pump to an applicator nozzle at a controlled temperature. The temperature control system of the invention comprises a hose assembly adapted to extend between the pump and the nozzle and including an inner flexible hose for carrying the viscous material and an outer flexible hose surrounding the inner hose and defining an annular space therebetween extending the length of the hose assembly; means for passing a heat transfer fluid through the annular space; and means for controlling the temperature of the heat transfer fluid and thereby the temperature of the viscous material being delivered through the inner hose to the nozzle. The arrangement provides a convenient and efficient means of controlling the temperature of the viscous material being delivered to the nozzle from the pump.

According to a further feature of the invention temperature control system, the means for passing the heat transfer fluid through the annular space is operative to pass the heat transfer fluid through the annular space in a direction opposite to the direction of flow of the viscous material through the inner hose. This counter-flow arrangement optimizes the heat transfer effect as between the heat transfer fluid and the viscous material.

According to a further feature of the invention temperature control system, the control means further includes a fluid conditioner for heating and cooling the heat transfer of fluid, a temperature sensor for sensing the temperature of the viscous material being delivered to the nozzle through the hose assembly, and a controller receiving a temperature signal from the temperature sensor and controlling the fluid conditioner in a sense to maintain a desired viscous material temperature at the nozzle. This arrangement facilitates the precise and ready control of the temperature of the heat transfer fluid and thereby of the viscous material.

In the disclosed embodiment of the invention, the fluid conditioner includes a heat transfer fluid pump, a heat transfer fluid heater, a heat transfer fluid chiller, and valve means for routing the heat transfer fluid selectively through the heater and the chiller.

BRIEF DESCRIPTION OF THE DRAWINGS

FIG. 3 is a perspective fragmentary view of a hose assembly utilized in the invention temperature control system;

FIG. 4 is an inboard end view of an end block utilized in the invention hose assembly;

FIG. 5 is a cross-sectional view taken on line 5—5 of FIG. 4;

FIG. 6 is a side view of the end block of FIGS. 4 and 5; and

DETAILED DESCRIPTION OF THE PREFERRED EMBODIMENT

Figures 1, 7:
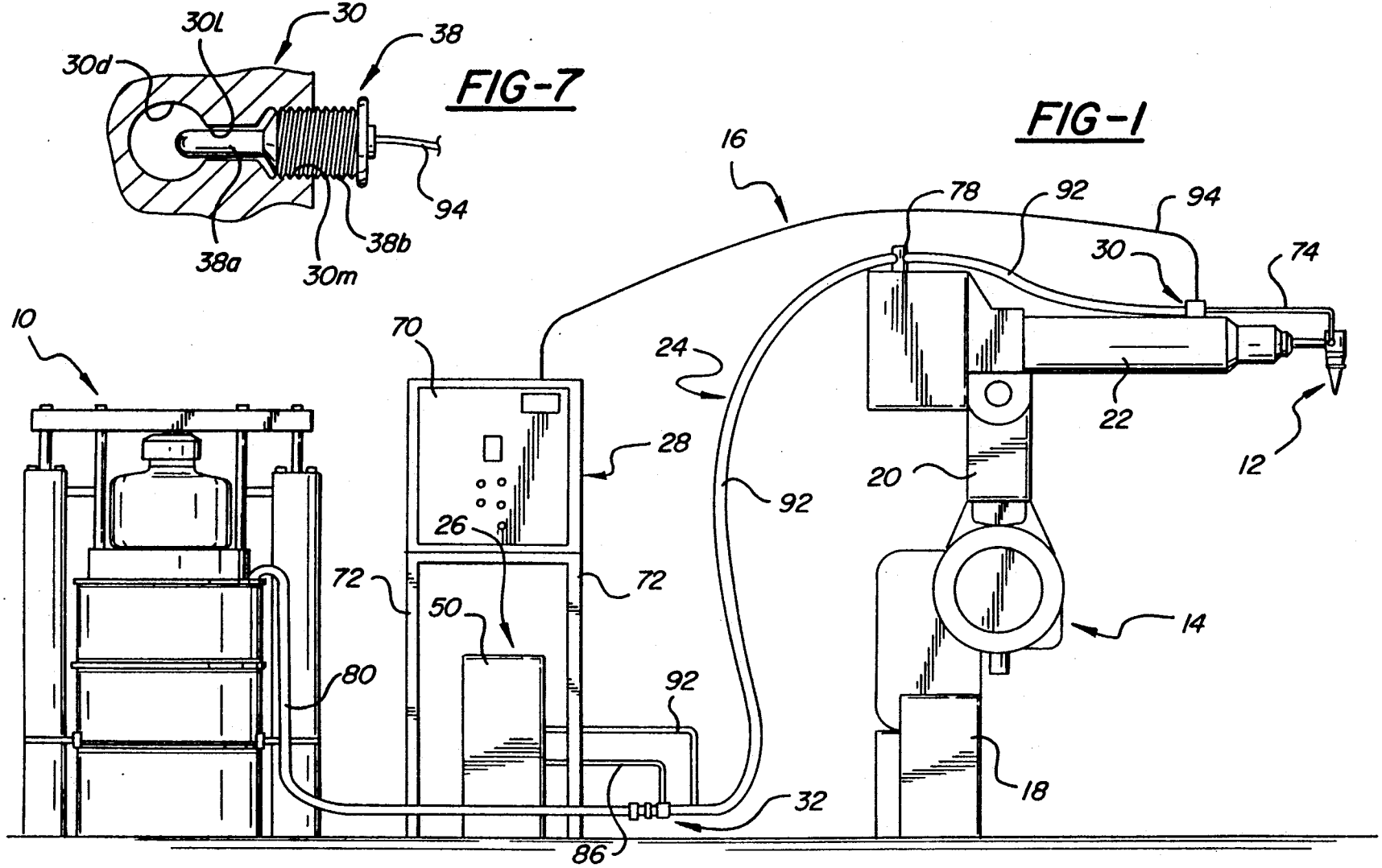
FIG. 1 is a side-elevational view of a viscous material applicator system utilizing a temperature control system according to the invention.
FIG. 7 is a fragmentary view of a portion of the end block of FIGS. 4–6.
Figure 2:
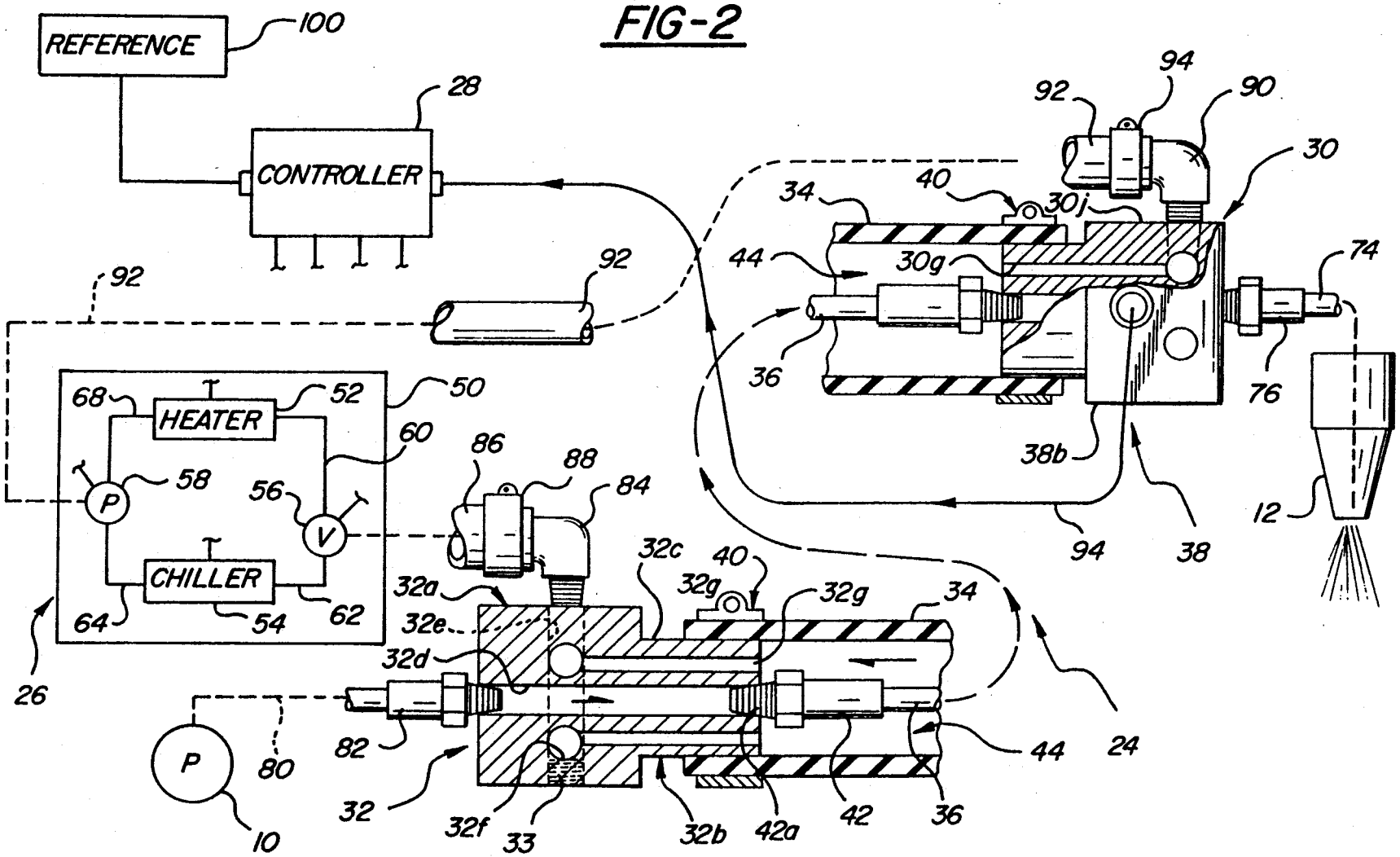
FIG. 2 is a fragmentary, somewhat schematic view of the invention temperature control system.

The viscous material applicator system seen in FIG. 1 includes an adhesive pump 10, a nozzle 12, a robot 14, and a temperature control system 16 for delivering adhesive in a temperature controlled manner from the pump to the nozzle.

Adhesive pump 10 may take various forms and may, for example, comprise an air driven positive displacement, high volume, high pressure, double-acting, suction assisted, double elevator, low shear piston pump of the type available from Johnstone Pump Company of Troy, Mich. as 1001 Series. Nozzle 12 is of known form and is operative in known manner to apply a bead of adhesive material to the surface of a part. Nozzle 12 is suitably mounted on robot 14.

Robot 14 is of known form and includes a pedestal 18, a primary arm 20 universally mounted on the pedestal 18, and a secondary arm 22 pivotally mounted on the primary arm 20. Nozzle 12 is mounted on the secondary arm 22 so that the robot may be programmed to move the nozzle in a predetermined pattern to apply a bead of adhesive material to a part in a predetermined pattern.

Temperature control system 16 includes a jacketed hose assembly 24, a water conditioner 26, and a controller 28.

Jacketed hose assembly 24 includes a right end block 30, a left end block 32, an outer hose 34, an inner hose 36, and a temperature sensor 28.

Right blocks 30 and 32 are formed of a suitable steel material.

Right end block 30 includes an outboard portion 30*a* of square cross section and a reduced diameter inboard portion 30*b* of circular cross section and defining an annular hose mounting surface 30*c*. A central through axial bore or passage 30*d* extends through the end block in concentric relation to the circular inboard end portion 30*b* with hose mounting surface 30*c* concentrically surrounding the inboard end of passage 30*d*. End block 30 further defines a heat transfer fluid passage means including a vertical through bore 30*e*, transverse bores 30*f* opening at their inboard ends in vertical bore 30*e*, and a plurality of circumferentially spaced axial bores 30*g* opening at their inboard ends in the inboard face 30*h* of inboard end portion 30*b* and opening at their outboard ends in vertical bore 30*e* or in a transverse bore 30*f*. Threaded plugs 33 plug the lower end of vertical bore 30*e* and the outboard ends of transverse bores 30*f* so that the bores 30*e*,30*f* and 30*g* coact to define passage means extending through the block from the inboard ends of the axial bores 30*g* to the opening 30*i* of the upper end of bore 30*e* in side face 30*j* of block portion 30*a*.

End block 30 further includes a transverse bore or passage 301 opening in passage 30*d* and a threaded transverse counterbore 30*m* opening in side face 30*n* of the block.

Left end block 32 is generally similar to right end block 30 except that it does not include a bore and counterbore corresponding to bore 301 and counterbore 30*m* of end block 30. Specifically, end block 32 includes an outboard end portion 32*a* of square cross section; an inboard end portion 32*b* of circular cross section and defining an annular hose mounting surface 32*c*; a central through axial bore or passage 32*d* concentric with respect to surface 32*c*; a heat transfer passage means including a vertical through bore 32*e*, transverse bores 32*f* opening at their inboard ends in vertical bore 32*e*, and a plurality of circumferentially spaced axial bores 32*g* opening at their inboard ends in the inboard face 32*h* of inboard end portion 32*b* and opening at their outboard ends in vertical bore 32*e* or in a transverse bore 32*f*; and threaded plugs 33 plugging the lower end of vertical bore 32*e* and the outboard ends of transverse bores 32*f* so that the bores 32*e*,32*f* and 32*g* coact to define passage means extending through the block from the inboard ends of the axial bores 32*g* to the opening 32*i* of the upper end of bore 32*e* in side face 32*j* of block portion 32*a*.

Outer hose 34 is formed of a suitable flexible elastomeric material and has a circular configuration. Hose 34 is sized to fit slidably at its opposite ends over the annular surfaces 30*c*,32*c* defined by the inboard end portions of the respective end blocks with hose clamps 40 clamping the ends of the hose 34 to the respective hose mounting surfaces 30*c*,32*c*.

Inner hose 36 is a high pressure hose formed of a suitable flexible reinforced rubber material. A fitting 42 is crimped onto each end of the hose 36 and each fitting 42 includes a threaded portion 42*a* for threaded engagement in the threaded inboard end of a respective bore 30*d*,32*d* so as to establish fluid communication between the hose 36 and the bores 30*d*,32*d* through the fittings 42.

It will be seen that hose 36 is positioned generally coaxially within outer hose 34 with an annular space 44 therebetween extending through the entire length of the hose assembly and with the inboard end of the heat transfer passage means in end block 30 communicating with one end of annular space 44 and the inboard end of the heat transfer passage means in end block 32 communicating with the other end of annular space 44.

Temperature sensor 38 includes a probe portion 38*a* extending through bore 301 in end block 30 to position the inboard tip of the probe portion in passage 30*d* and a threaded main body portion 38*b* threaded into counter bore 30*m*. Sensor 38 may comprise a thermocouple of known form and is operative in known manner to generate an electrical signal proportional to the temperature being sensed by the inboard end of the probe 38*a*.

Water conditioner 26 includes a cabinet 50 and a heater 52, chiller 54, valve 56, and pump 58 all positioned within the cabinet. Valve 56 is connected to heater 52 and chiller 54 by conduits 60 and 62 so that the valve may function to selectively route fluid delivered to the valve to the heater or the chiller. Conduits 64 and 66 connect the chiller and heater respectively to pump 58 so that the pump receives the output of the heater or the chiller.

Controller 28 is of known form and may comprise for example a unit available from Omron Corporation of Schaumburg, Ill. as E5EX Series. Controller 28 may be housed for example in a cabinet 70 positioned over water conditioner cabinet 50 and supported by legs 72 straddling water conditioner cabinet 50.

In the assembled relation of the invention temperature control system and the invention hose assembly in the adhesive applicator system of FIG. 1, right end block 30 is suitably secured to one end of robot arm 22 proximate nozzle 12; a conduit 74 is connected at one end to nozzle 12 and is connected at its other end to end block 30 by a fitting 76 threaded into the threaded outboard end of bore 30*d*; a clamp 78 mounts an intermediate portion of the hose assembly to the rear end of robot arm 22; a pipe 80 extends from the output of pump 10 and is connected to left end block 32 by a fitting 82 threaded into the threaded outboard end of bore 32*d*; a fitting 84 is threaded into the threaded upper end of vertical bore 32*e* in end block 32; a hose 86 is secured by a clamp 88 to fitting 84 and extends through cabinet 50 for connection to valve 56; a fitting 90 is threaded into the upper end of vertical bore 30*e* in end block 30; a hose 92 is clamped by a clamp 94 to the fitting 90 and extends at its other end through cabinet 50 for connection to pump 58; and a lead 94 extends from sensor 38 to controller 28.

In operation, adhesive or mastic material is delivered by pump 10 through pipe 80 for delivery to nozzle 12 for suitable application to a surface of a part with the pattern of movement of the nozzle 12, and thereby the pattern of the bead applied by the nozzle 12, being determined by the preprogramming of the robot 14. It will be understood that the adhesive material moves slowly through the system and may, for example, take as long as an hour to move from the pump to the nozzle. As the mastic material moves slowly through the system from the pump to the nozzle the temperature, and thereby the viscosity of the material, is carefully controlled by the temperature control system 16.

Specifically, the adhesive material moves slowly through pipe 80, fitting 82, passage 30*d*, fitting 42, inner hose 36, fitting 42, passage 30*d*, fitting 76 and conduit 74 to nozzle 12 for application to the part while the temperature control system operates to maintain a continuous flow of heat transfer fluid (such for example as water) through annular passage 44 in a direction opposite to the direction of flow of the adhesive material with the heat transfer fluid entering the annular space 44 via fitting 90 and bores 30*g* and exiting the annular space 44 via bores 32*g* and fitting 84. The heat transfer fluid exiting the annular space 44 via the fitting 84 is delivered via hose 86 to valve 56 where it is delivered either to the heater 52 and/or the chiller 54 in accordance with control signals received from controller 28.

Controller 28 looks at a reference desired temperature signal that is provided by a reference unit 100, compares the reference signal to the temperature signal being transmitted to the controller via lead 94 from temperature sensor 38, and generates appropriate control signals for delivery to the valve 56, heater 52, and chiller 54 to control the temperature of the water flowing through the passage 44 in a manner to maintain the desired adhesive temperature at the nozzle 12.

The temperature at which the water is maintained in the passage 44 will of course vary depending upon the desired temperature and viscosity of the adhesive material at the nozzle. For example, if it is desired to maintain a water temperature in the passage 44 of between 70° and 80° (and thereby an adhesive material temperature between 70° and 80°) the heater 52 may be sized and energized to heat the water delivered to it to 120° F., the chiller 54 may be sized and energized to cool the water delivered to it to 50° F., and the valve 56 may be selectively controlled to route water through the chiller and/or the heater in a manner to provide water in the hose 92 at between 70°-80° F.

The invention will be seen to provide an improved hose assembly and an improved adhesive temperature control system utilizing the improved hose assembly. The invention temperature control system, including the invention hose assembly, is simple and inexpensive in construction and is very effective in providing precise temperature, and thereby viscosity, control for the heat transfer fluid and thereby for the adhesive material being delivered to the nozzle.

Whereas a preferred embodiment of the invention has been illustrated and described in detail it will be apparent that various changes may be made in the disclosed embodiment without departing from the scope or spirit of the invention.

We claim:

1. A temperature control system for delivering a viscous material from a pump to an application nozzle at a controlled temperature, said temperature control system comprising:

a hose assembly extending between the pump and the nozzle and including an inner flexible hose for carrying the viscous material and an outer flexible hose surrounding the inner hose and defining an annular space therebetween extending the length of the hose assembly;

means for passing a heat transfer fluid through the annular space; and means for controlling the temperature of the heat transfer fluid and thereby the temperature of the viscous material being delivered through the inner hose to the nozzle;

said hose assembly including a pair of rigid end blocks each having an inboard end and an outboard end, each including a central through axial passage extending from the outboard end to the inboard end of the block, and each defining an annular hose mounting surface proximate the inboard end of the block in surrounding relation to the inboard end of the central passage;

the outer flexible hose being fitted at its opposite ends on the annular hose mounting surfaces of the respective block;

the opposite ends of the inner flexible hose respectively communicating with the inboard ends of the central passages of the respective block;

each block further including further passage means communicating at one end thereof with the exterior of the block and communicating at the other end thereof with the annular space between the inner and outer hoses so as to facilitate the delivery of the heat transfer fluid to the annular space and removal of the heat transfer fluid from the annular space;

the temperature control system further including a temperature sensor mounted in one of said end blocks and including a probe extending into the central passage of said one block.

2. A temperature control system according to claim 1 wherein the system includes a heat transfer fluid pump, a heat transfer fluid heater, a heat transfer fluid chiller, and valve means for routing the heat transfer fluid selectably through the heater and the chiller.

3. A temperature control system according to claim 1 wherein said one end of said further passage means in each of said blocks opens in an axially extending side surface of the block.

4. A temperature control system according to claim 3 wherein each block has a polygonal cross-sectional configuration proximate its outport end and a circular cross-sectional configuration proximate its inboard end, the outer hose has a circular configuration and is fitted at its opposite ends over the circular inboard ends of the respective blocks, and the one end of the further passage means in each block opens in a polygonal side face of the block.

* * * * *